US010017927B2

(12) United States Patent
Panea Medina et al.

(10) Patent No.: US 10,017,927 B2
(45) Date of Patent: Jul. 10, 2018

(54) DUAL-DISCHARGE TANK FOR TOILETS

(71) Applicants: Domingo Panea Medina, Badajoz (ES); Ángel Reyes Guerrero, Badajoz (ES); Maria Isabel Guerrero Serrano, Badajoz (ES); Luis Fernandez Delgado, Badajoz (ES)

(72) Inventors: Domingo Panea Medina, Badajoz (ES); Ángel Reyes Guerrero, Badajoz (ES); Maria Isabel Guerrero Serrano, Badajoz (ES); Luis Fernandez Delgado, Badajoz (ES)

(73) Assignee: EXTRAMANOVA, S.L., Zafra (Badajoz) (ES)

( * ) Notice: Subject to any disclaimer, the term of this patent is extended or adjusted under 35 U.S.C. 154(b) by 0 days.

(21) Appl. No.: 15/504,675

(22) PCT Filed: Aug. 19, 2015

(86) PCT No.: PCT/ES2015/000110
§ 371 (c)(1),
(2) Date: Feb. 17, 2017

(87) PCT Pub. No.: WO2016/026991
PCT Pub. Date: Feb. 25, 2016

(65) Prior Publication Data

US 2017/0306600 A1 Oct. 26, 2017

(30) Foreign Application Priority Data

Aug. 20, 2014 (ES) ..... 201431238

(51) Int. Cl.
*E03D 1/14* (2006.01)
*E03D 3/12* (2006.01)
*E03D 5/092* (2006.01)

(52) U.S. Cl.
CPC ..... *E03D 1/14* (2013.01); *E03D 5/092* (2013.01)

(58) Field of Classification Search
CPC ..... E03D 1/14; E03D 1/142; E03D 1/145; E03D 5/092
(Continued)

(56) References Cited

U.S. PATENT DOCUMENTS 2,690,567 A * 10/1954 Quebbeman ..... E03D 1/142 4/381
2,883,675 A * 4/1959 Hartman, Jr. ..... E03D 1/142 4/324
(Continued)

FOREIGN PATENT DOCUMENTS

EP 2097680 A2 9/2009
ES 1026499 U 5/1994
ES 1042229 U 8/1999

OTHER PUBLICATIONS

International Search Report for PCT/ES2015/000110 dated Sep. 29, 2015.

*Primary Examiner* — Benjamin R Shaw
(74) *Attorney, Agent, or Firm* — Brown & Michaels, PC

(57) ABSTRACT

The invention relates to a dual-discharge tank for toilets, including a tank, a water inlet having controlling means which are activated depending on the volume of water contained in the tank, a discharge mechanism coupled to a drainage collector, and means for actuating the discharge mechanism. The tank also includes an additional water inlet connected to a timed valve for controlling water flow, which automatically cuts off the flow of water through said inlet after a predetermined time has elapsed since the actuation thereof. The outlet of the timed valve for controlling water
(Continued)

flow is connected to a first pipe that directs the additional water toward the drainage collector.

8 Claims, 1 Drawing Sheet

(58) Field of Classification Search
USPC ..... 4/326, 324; 137/624.11
See application file for complete search history.

(56) References Cited

U.S. PATENT DOCUMENTS

| | | | | | |
|---|---|---|---|---|---|
| 4,145,775 | A * | 3/1979 | Butler | E03D 1/142 | 4/415 |
| 4,173,801 | A * | 11/1979 | Bresnyan | E03D 1/145 | 4/249 |
| 5,187,818 | A * | 2/1993 | Barrett, Sr. | E03D 5/105 | 4/304 |
| 5,495,624 | A * | 3/1996 | Lisook | E03D 1/00 | 4/325 |
| 5,887,294 | A * | 3/1999 | Yeung | E03D 1/14 | 138/44 |
| 2004/0025238 | A1* | 2/2004 | Parsons | E03D 1/142 | 4/378 |
| 2008/0034488 | A1 | 2/2008 | Lusch | | |
| 2008/0120770 | A1* | 5/2008 | Murphy | E03D 3/02 | 4/324 |
| 2008/0216223 | A1* | 9/2008 | White | E03D 1/14 | 4/324 |

* cited by examiner

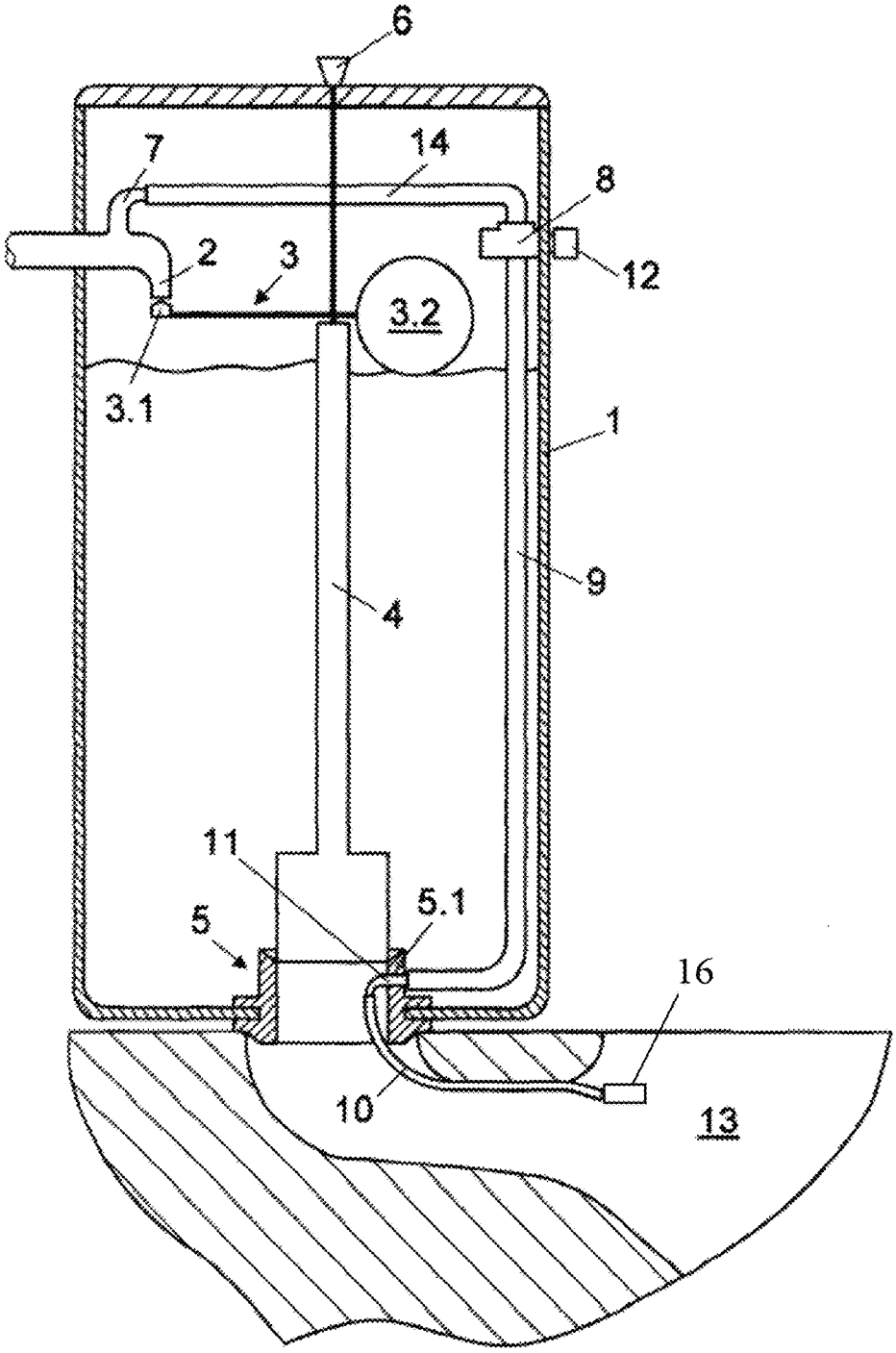
6
7
14
8
2
3
12
3.2
3.1
1
9
4
11
5.1
5
16
10
13

DUAL-DISCHARGE TANK FOR TOILETS

BACKGROUND OF THE INVENTION

Field of the Invention

The present invention relates to a tank used for water storage in toilets, specifically, those designed to allow selective download of two different volumes of water suited to the particular requirements of each use—either a reduced amount sufficient water for the removal of organic waste liquids, or increased water discharge, in order to also evacuate solid organic waste.

Thus, is achieved a lower water consumption, suited to the needs of each type of use given to the toilet to which the tank is coupled.

Description of Related Art

Most commonly, the vast majority of tanks are structured from a tank mounted on the back of the toilet. The tank is attached to the toilet by a drainage collector that is inserted into the latter with a gasket disposed between them. On the drainage collector is coupled a discharge valve mechanism which is operated from outside the tank when it is desired to produce the discharge of the water contained in said tank into the toilet.

These prior-art tanks, even though they perform their function properly, have the disadvantage that involve excessive water consumption, since every time the toilet is used, the tank is discharged entirely, which, is necessary only when there is presence of solid organic waste.

They are also other known solutions based on dual-flush toilets, which can overcome the problem posed above. For example, the utility model ES 1026499, published on May 1, 1994, which shows a dual-use toilet tank comprising two water tanks, one of quite smaller size and capacity than the other, divided by a septum and communicated both with each other through a duct equipped with a simple pressure valve, which allows the passage of water to the larger tank and at the same time its retention in it, so that only require a single duct inlet or water supply and a single general drain conduit. The discharge of both tanks is performed by the same arm, which is operated by a lever that has a first position that produces small tank discharge, and a highest second position that initiates discharging the largest tank.

Likewise, the utility model ES 1042229, published on Aug. 16, 1999, discloses a dual-use toilet comprising a tank incorporating therein a septum determinant of two compartments, markedly unequal, provided each one with a discharge orifice over the toilet, with their respective valve closing systems with independent actuators which allow selective discharge of one or another of the compartments.

The above solutions, even though allowing the user to perform selective toilet flush depending on the presence or absence of organic waste solids therein, regulating the consumption of water, generate a new problem with the increased size and weight of the tank, to be double deposit include: one with the volume of a tank of a conventional tank, i.e. with sufficient water to allow for evacuation of solid waste, and other, smaller volume.

Therefore, it is required to design a dual flush tank for toilets that allows a simple and economical way to overcome the problem posed above.

SUMMARY OF THE INVENTION

The present invention is characterized in the independent claim, while the dependent claims describe other characteristics of the same.

In view of the above stated, the present invention relates to a dual-discharge tank for dual flush toilets.

The tank comprises a tank, a water inlet with regulating means which are activated depending on the volume of water content in the tank, a discharge mechanism coupled to a drain collector, and means for actuating the discharge mechanism, which can be operated when there is presence of organic solid waste in the toilet, encouraging the complete emptying of the tank as required.

In addition, the tank comprises a complementary water inlet connected to a timed flow control valve whose output is connected in turn to a first pipe that channels the additional water into the drain collector.

The timed flow control valve is actuated when you want to cause the toilet to flush when there is only organic waste liquid. In this case, said valve automatically cuts the water flow through it after a predetermined time after it was activated. Said predetermined operating time of the valve is based on a minimum volume of water required to discharge the toilet, to eliminate organic waste liquid completely.

Thus, it is possible to have a solution that allows the toilet to be selectively flushed depending on the waste that it contains, without requiring an increase in size or weight of the tank and may be used in a conventional tank.

BRIEF DESCRIPTION OF THE DRAWING

The drawings show an illustrative FIGURE of the preferred embodiment, and are not intended to limit the scope of the invention.

FIG. 1 shows a schematic cross section of a dual flush tank according to the present invention.

DETAILED DESCRIPTION OF THE INVENTION

In view of the above stated, the present invention relates to a dual-discharge tank for flush toilets.

As shows FIG. 1, the tank comprises a tank (1), a water inlet (2) with regulating means (3) which are activated depending on the volume of water contained in the tank (1), a discharge mechanism (4) coupled to a drainage collector (5), and drive means (6) for the discharge mechanism (4).

Regulating means (3) of the water inlet (2) may be, for example, a bypass valve (3.1) operated by a float (3.2). Thus, when the water level in the tank (1) decreases, resulting from driving a discharge mechanism (4) to remove organic solid waste toilet (13), the tank (1) is emptied and the bypass valve is released (3.1), allowing the entry of water to the tank (1) until the volume of water within it regains its initial level.

In addition, the tank comprises an additional inlet for water (7) connected to a timed flow control valve (8). This connection of additional water should be used only if you want to discharge the toilet (13) for the presence of organic waste liquids.

Preferably, the timed flow regulating valve (8) is actuated by a button (12) disposed outside the tank (1). The button (12) could alternatively be an electronic detection cell 12 disposed outside the tank (1). In the latter case, it is sufficient to bring the user's hand to said electronic detection cell (12) to operate the discharge of additional water.

Once the timed valve (8) is operated, this automatically cuts off the water flow after a predetermined time from its operation, being its output connected to a first pipe (9) which channels the additional water into the drainage collector (5).

The operating time of the timed valve (8) is defined in order to guarantee, in the discharge, the minimum water flow which completely removes the organic waste liquids from the toilet (13).

Meanwhile, it is preferred that the first pipe (9) is connected to a second pipe (10) of smaller diameter, increasing the output speed of the additional water from the drainage collector (5).

For the same purpose, additionally, the second pipe (10) may have a water diffuser 16 at its free end.

Likewise, it is preferred that the first pipe (9) is connected to the second pipe (10) through a coupling piece (11). For example, said coupling piece (11) may be formed by a 90° elbow.

Preferably, the coupling piece (11) is fixed to the drainage collector (5) through its lateral wall (5.1).

Thus, the second connector (10) is disposed at the center of the toilet (13), which commonly goes out the discharge water.

Furthermore, it is preferred that the supplementary water inlet (7) is connected to the flow regulating valve (8) via a third pipe (14). For example, the connectors (9, 10, 14) may be formed by flexible plastic tubes.

In this way, a dual-discharge tank is provided that uses the same tank (1) as a conventional toilet tank. That is, it is not required to modify the size of the tank (1) or its internal structure—rather, it is sufficient to equip the conventional tank with a connection of additional water as described above. Thus, when the user wants to flush the toilet (13) to evacuate only waste organic liquid, limited additional water volume would discharge, and when the use wants to remove solid organic waste, it will be carry on emptying the conventional tank (1) to provide a sufficient water volume which allows to remove the organic solid waste completely from the toilet (13).

What is claimed is:

1. A dual-discharge tank for toilets, comprising:

a tank for holding a volume of water;

a water inlet having a regulator which is activated depending on the volume of water contained in the tank a discharge mechanism coupled to a drainage collector, and having a drive means; and an additional water inlet connected to a timed flow regulating valve having an output, connected to a first pipe which directs additional water from the additional water inlet into the drainage collector.

2. The tank of claim 1, wherein the first pipe is connected to a second pipe smaller diameter, increasing an output speed of the additional water into the drainage collector.

3. The tank of claim 2, further comprising a water diffuser at a free end of the second pipe.

4. The tank of claim 2, further comprising a coupling piece connecting the first pipe to the second pipe.

5. The tank of claim 3, wherein the coupling piece is a 90° elbow.

6. The tank of claim 3, wherein the coupling piece is fixed to a lateral wall of the drainage collector.

7. The tank of claim 1, further comprising a push button located outside the tank, arranged to operate the timed flow regulating valve.

8. The tank of claim 1, further comprising an electronic detection cell located outside the tank, connected to the timed flow regulating valve such that the timed flow regulating valve is operated when a user's hand is detected by the electronic detection cell.

* * * * *